United States Patent [19]

Johnson

[11] Patent Number: 4,676,202

[45] Date of Patent: Jun. 30, 1987

[54] ENGINE COOLING SYSTEM

[76] Inventor: Kenneth A. Johnson, 15236 Tacoma St., Wayne County, Mich. 48205

[21] Appl. No.: 859,553

[22] Filed: May 5, 1986

[51] Int. Cl.[4] ..... F01P 1/02

[52] U.S. Cl. ..... 123/41.67; 123/41.76

[58] Field of Search ..... 123/41.58, 41.6, 41.61, 123/41.62, 41.67, 41.68, 41.76, 41.77

[56] References Cited

U.S. PATENT DOCUMENTS

| | | | |
|---|---|---|---|
| 719,326 | 1/1903 | Gross | 123/41.67 |
| 1,035,391 | 8/1912 | Simpson | 123/41.68 |
| 2,078,499 | 4/1937 | Ljungström | 123/41.67 |
| 2,209,078 | 7/1940 | Gettinger | 123/41.68 |
| 2,214,321 | 9/1940 | Browne | 123/41.67 |
| 2,781,034 | 2/1957 | Herschmann | 123/41.67 |
| 2,853,061 | 9/1958 | Elsbett | 123/41.67 |
| 3,618,691 | 11/1971 | Honda | 123/41.67 |
| 3,669,203 | 6/1972 | Honda | 123/41.67 |
| 4,046,114 | 9/1977 | Hamparian et al. | 123/41.76 |
| 4,573,436 | 3/1986 | Owens | 123/41.67 |

*Primary Examiner*—William A. Cuchlinski, Jr.

[57] ABSTRACT

A closed passage system surrounding an engine cylinder for cooling purposes. Fins extend longitudinally along the various passage sections to promote heat transfer into the air flowing through the passage. Fin density varies according to the heat load. Near the upper end of the combustion chamber, a large fin density is used; near the lower end of the chamber a lesser fin density is employed. An effort is made to continuously guide the coolant air for efficient heat removal action.

10 Claims, 6 Drawing Figures

ENGINE COOLING SYSTEM

GOVERNMENT INTEREST

The invention described herein may be manufactured, used, and licensed by or for the Government for governmental purposes without payment to me of any royalty.

The invention is an improvement on an invention disclosed in my U.S. patent application, Ser. No. 725,972 filed on Apr. 22, 1985.

BACKGROUND AND SUMMARY OF THE INVENTION

This invention relates to a mechanism for cooling engines, especially engines used in military tanks.

Military tanks are commonly powered by diesel engines having a number of cylinders, e.g., twelve cylinders arranged in two banks of six cylinders per bank. The tanks usually weigh several tons, e.g., between forty and sixty tons. Accordingly, the propulsion engines are required to have large power outputs, e.g., 1,200 horsepower or more. The individual engine cylinders have relatively large diameters and stroke lengths, e.g., approximately four inches.

The above factors result in large engine cooling loads. Commonly, water is used as the engine coolant. However, the heated water must, in turn, be cooled before recirculation through the coolant passages in the engine. To accomplish such cooling of the water, it is common to pass the heated water through radiators. Engine-driven fans are located in aerodynamic alignment with the radiators to draw ambient air through the radiators for effecting a coolant action on the water within the radiator.

Even though the engines may be water-cooled, the ultimate (final) cooling action is accomplished by the fan-induced air flow through the radiators. Relatively large air quantities are required.

One existing military tank is powered by an air-cooled engine, designated as the AVDS-1790. That particular engine is equipped with two large fans located on the engine centerline above the engine cylinders; each cylinder has a large number of external cooling fins on its cylinder head area. The two large fans draw ambient air across the external fins to cool the individual cylinders. Large quantities of air are required.

Military tanks differ from conventional automobiles and trucks in that tank hulls are usually constructed with a minimum number of openings or slots in the hull walls; design efforts are made to protect the human occupants and power plant from enemy projectiles, mines, grenades, etc. The aim is to provide as few openings as possible in the hull-turret envelope, and to make any such openings as small as possible areawise.

The presence of large air-water radiators in military tanks is a disadvantage from the standpoint that such radiators subtract from the armored wall area. Such radiators are also disadvantageous from the standpoint that if the radiators should be pierced by an enemy projectile or fragment, the resultant water leakage out of the radiators will cause failure of the cooling systems and overheating of the associated engines.

The presence of large fans in military tanks is similarly disadvantageous in that the associated air flow openings subtract from the armored wall area. In some cases, ballistic grilles are placed across the air flow openings to intercept enemy projectiles or munition fragments. However, such grilles add to the vehicle weight and cut down on the air flow. It would be desirable to eliminate the need for ballistic grilles, or to at least reduce the required face area of such grilles. In a related sense, it would be desirable to reduce the quantity of air required for engine cooling purposes.

I propose an engine-cooling system that overcomes some of the disadvantages of existing engine cooling systems. In the proposed system pressurized air is directed through closed (confined) passages extending around and over each engine cylinder. Each passage has a series of heat transfer fins therein extending in the direction of air flow, i.e., longitudinally along the passage surface. The fins occupy the full height of each passage, such that none of the air is able to bypass the fins; the air is required to flow through the fin spaces rather than over or around the finned areas.

A principal advantage of my invention is the fact that no chassis-mounted radiators or auxiliary fans are required. Another possible advantage of my invention is achievement of coolant air flow at the expense of a greatly reduced air flow requirement for coolant purposes. In my proposed arrangement the coolant air is caused to flow through passages running through the engine in close proximity to the combustion chambers and exhaust passages; the coolant air experiences a much greater temperature increase than the coolant in conventional engine cooling arrangements.

The relatively large temperature rise in the coolant air stream means that only a relatively small quantity of air is required to achieve a given cooling action (considerably smaller than either air or water cooled systems). Smaller air quantities (mass flow rates) translate into relatively small power expenditures (losses) and small air intake openings in the hull surface.

THE DRAWINGS

Figure 5:
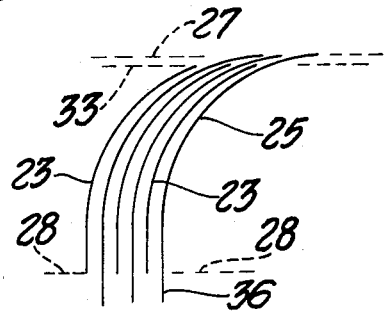

FIG. 5 schematically illustrates a fin orientation used in the illustrated embodiment of the invention.

Figure 6:
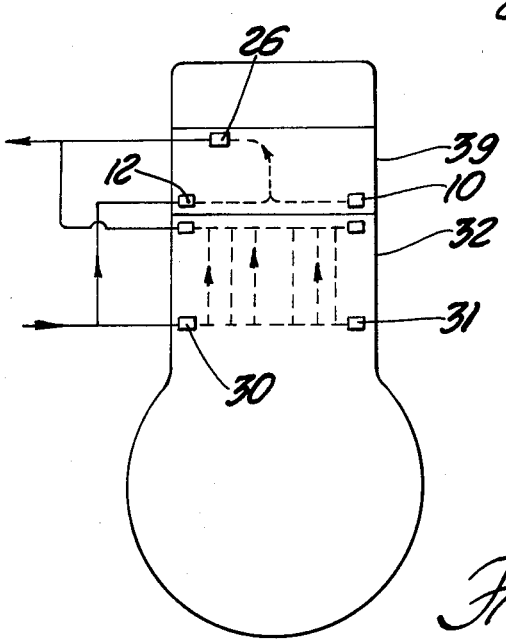

FIG. 6 illustrates a piping arrangement utilizing the invention.

THE DRAWINGS IN GREATER DETAIL

Figure 1:
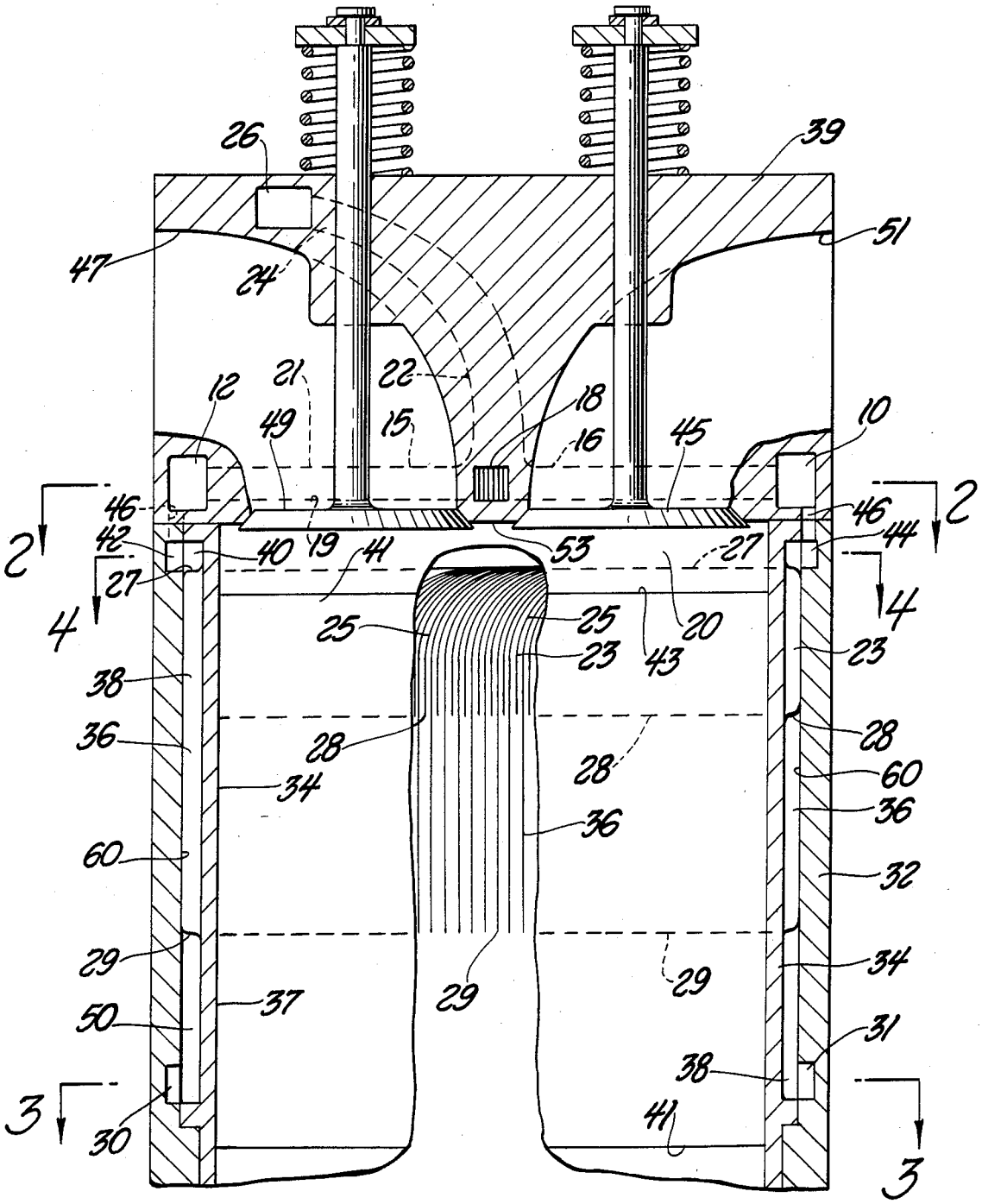
FIG. 1 is a sectional view taken through one cylinder of an engine modified to utilize my invention.

FIG. 1 shows an engine that includes a cylinder block 32 having a cylindrical liner 34 mounted within a bore 35 in the block. The inner surface 37 of liner 34 forms the side wall of a combustion chamber 20. A cylinder head 39 is suitably secured to block 32 to define an end surface 53 for combustion chamber 20. A conventional piston 41 is slidably mounted within liner 34 for axial reciprocatory motion therein; end surface 43 of the piston defines the so-called "movable" end surface of combustion chamber 20. A conventional connecting rod-crankshaft mechanism (not shown) is provided for translating piston 41 motion into useful mechanical rotation.

Figure 2:
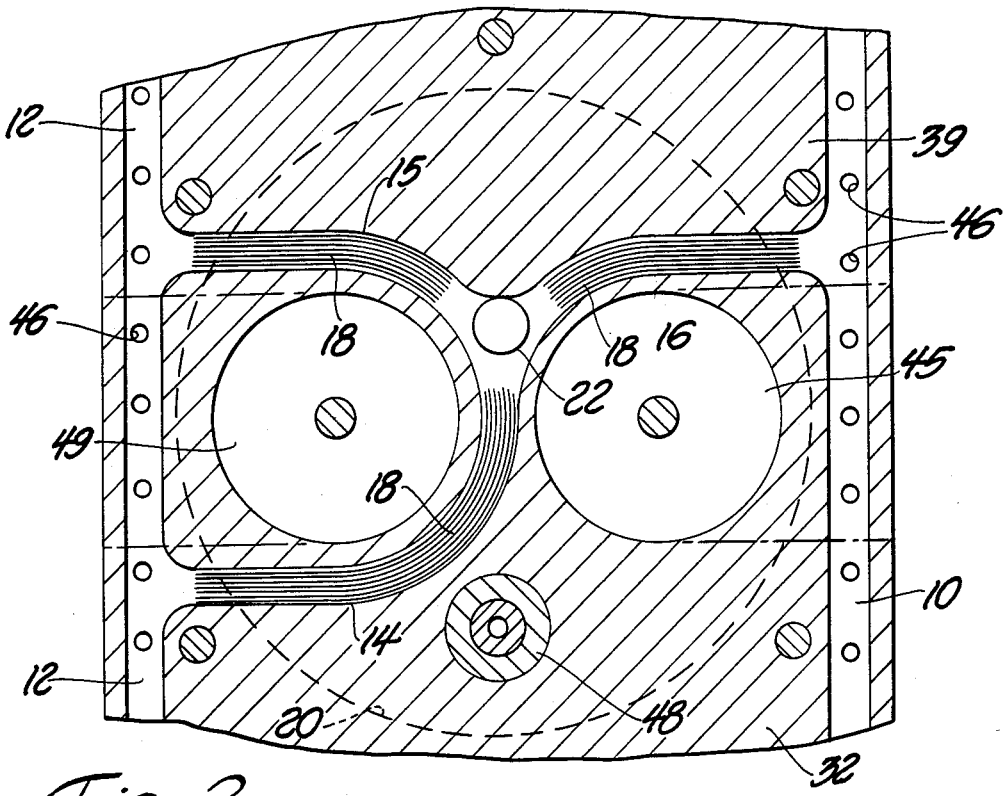
FIG. 2 is a sectional view taken on line 2—2 in FIG. 1.

Air for supporting combustion is introduced to chamber 20 through an intake passage 51 formed in cylinder head 39. Air flow is controlled by a conventional poppet valve 45 (FIG. 2). In the case of a carburetted engine fuel is introduced to the combustion chamber as entrained droplets in the incoming air stream. In the case of a compression-ignition engine, the fuel may be introduced to the combustion chamber through fuel injectors mounted in head 39. One such injector is shown at 48 in FIG. 2.

Products of combustion are exhausted from chamber 20 through an exhaust passage 47 containing a second conventional poppet valve 49. The orientation of valves 45 and 49 relative to combustion chamber 20 is shown in FIG. 2.

The valves may be operated by cam or solenoid means (not shown) arranged in the space above cylinder head 39. The complete engine comprises a number of cylinders 34 located at spaced points along the length of cylinder block 32. Each cylinder 34 would be equipped with an intake valve 45 and an exhaust valve 49, as under conventional practice.

Figure 3:
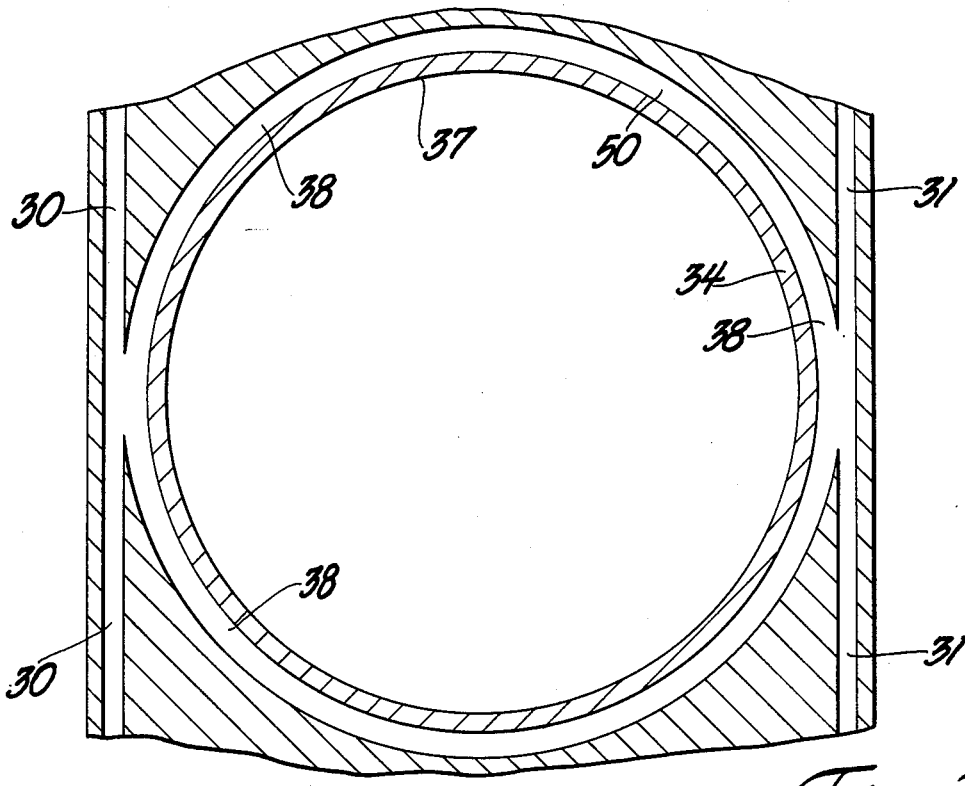
FIG. 3 is a sectional view taken on line 3—3 in FIG. 1.
Figure 4:
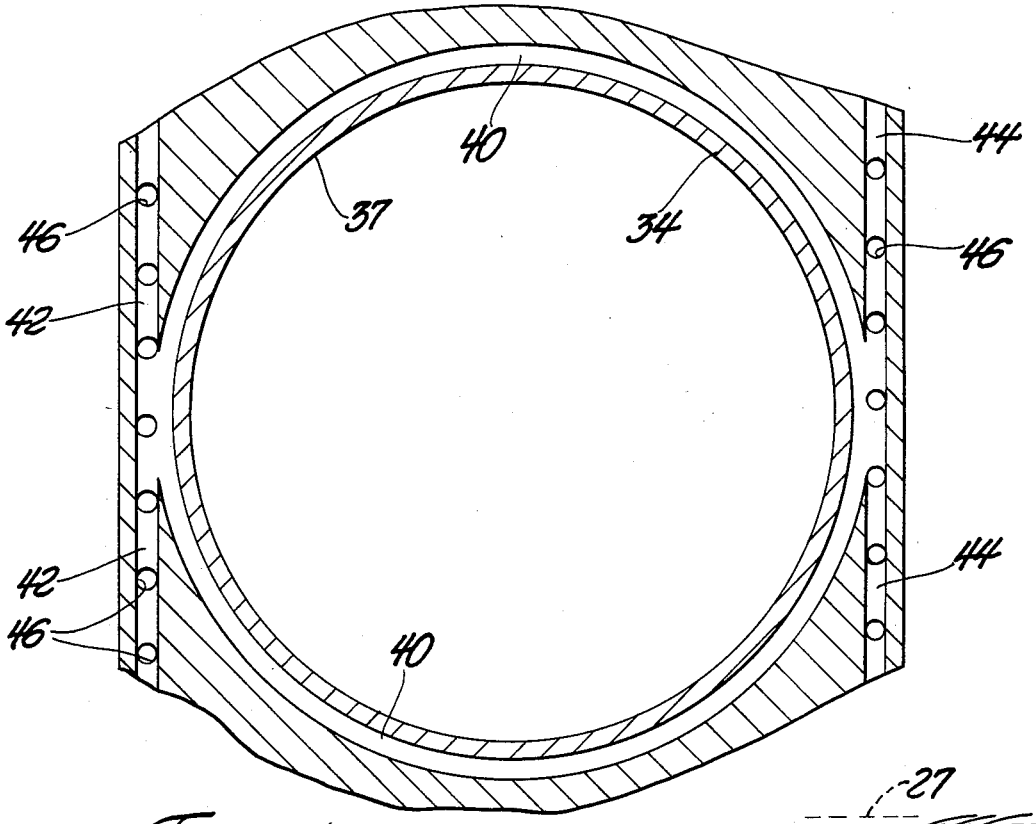
FIG. 4 is a sectional view on line 4—4 in FIG. 1.

FIGS. 1 and 2 illustrate features of an air coolant passage means for cooling exhaust valve 49 and end surface 53 of combustion chamber 20. FIGS. 1, 3 and 4 illustrate features of an air coolant passage means for cooling the side wall (liner 34) of the combustion chamber.

The air (coolant) passage means of FIG. 2 and the air (coolant) passage means of FIGS. 3 and 4 may be connected to a common air pressure source (not shown) in series flow relation or parallel flow relation. FIGS. 1 through 4 show a series flow relationship; i.e., the pressurized air first cools the cylinder side wall and then the cylinder end wall. FIG. 6 schematically shows a parallel flow relationship wherein the source air is divided into two streams; one stream cools the cylinder side wall, and the other stream cools the cylinder end wall. In one contemplated arrangement, the air pressure source comprises an axial fan driven by an engine exhaust turbine. Contemplated air supply pressure may be on the order of two p.s.i.g.

CYLINDER END WALL COOLING

As noted above, the coolant mechanism for the combustion end wall (surface) 53 is shown in FIGS. 1 and 2. The air passage means comprises two intake air ducts 10 and 12 extending within cylinder head 39 outboard from the various valves 49 and 45. Ducts 10 and 12 may be viewed as an intake manifold for coolant air. At each cylinder air is diverted from ducts 10 and 12 into branch passages 14, 15 and 16 (FIG. 2). These passages extend horizontally above the combustion chamber end wall 53; pressurized air flowing through passages 14, 15 and 16 removes heat that is generated by the combustion process at chamber end surface 53 and the lower faces of valves 45 and 49. When the valves are in their closed positions some heat is transferred across the valve-seat interface. Passages 14, 15 and 16 indirectly act as coolant sinks for the valves.

The heat exchange efficiency of each passage 14, 15 or 16 is considerably improved by means of heat transfer fins 18 extending longitudinally along the passage length. As best seen in FIG. 1, fins 18 extend the full height of each passage, from floor 19 to roof 21. Air is forced to flow through the fin spaces without bypassing the fin spaces. The closeness of the fins to one another (fin spacing) becomes a factor in the heat transfer action. A comparatively close fin spacing (e.g., ten fins per inch) is contemplated.

After movement through passages 14, 15 and 16 the air passes into a vertical duct 22 that transitions into a horizontal duct 24. Duct 24 that runs horizontally along cylinder head 39 (normal to the plane of the paper in FIG. 1). Duct 26 serves as an exhaust manifold for the total air flow used to cool the various cylinder end surfaces 53 and associated valves.

As seen in FIG. 1, each passage 14, 15 or 16 extends within cylinder head 39 in general parallelism with chamber end surface 53. As seen in FIG. 2, each passage 14 or 15 extends around the peripheral edge of exhaust valve 49 such that air flowing through the passage is able to cool the exhaust valve and a substantial portion of chamber end surface 53. Passage 16 extends fairly close to the edge of valve 45 to provide some cooling for that valve. Valve 49 requires greater cooling than valve 45; hence two passages 14 and 15 are associated with that valve, whereas only one valve 16 is associated with valve 45.

Passages 14, 15 and 16 may be of generally constant transverse width (measured transverse to the direction of flow), such that the space between fins 18 are of generally constant width from one end of the passage to the other. The individual heat transfer fins may be oriented in planes parallel to the height dimension of the associated passage (i.e., normal to surface 53); the fins extend the full height of the associated passage such that all of the air flowing through the passage is directed into the fin spaces. There is no by-passage around the fins. Passage (duct) sections 22 and 24 have no fins therein.

It should be noted however, that passage configuration may be dictated by other head design features, e.g., intake-exhaust port design or orientation, and/or fuel injector-spark plug location, and bolt boss locations. Therefore, in some cases, the individual passages could be relatively narrow at some points along the passage length and relatively wide at other points along the passage length. Desirably, any transitional changes in passage width would be gradual to minimize pressure losses.

CYLINDER SIDE WALL COOLING

The air (coolant) passage means for cooling the cylinder side wall is shown in FIGS. 1, 3 and 4. Supply air is caused to flow through passages 30 and 31 that extend along the bank of cylinders. In a typical system, passages 30 and 31 would communicate with the aforementioned exhaust turbine-driven fan. At each cylinder some of the pressurized air is diverted into an annular space (chamber) 38 that extends around cylinder liner 34. The connections between passages 30 and 31 and chamber 38 form air entrance ports for coolant air.

FIG. 1 includes a cutaway section that illustrates certain heat transfer fins 36 extending radially outwardly from liner 34 in the upper part of chamber 38. These fins have lower end edges 29 located at an intermediate point along the length of liner 34, leaving the lower portion 50 of chamber 38 unfinned. The upper edges 27 of fins 36 are located close to the plane of combustion chamber end surface 53, leaving an unfinned annular space (passage) 40 around the upper end of liner 34. Chamber 38 has an axial dimension approximately the same as the combustion chamber length.

Aforementioned passage 40 communicates with longitudinally extending passages 42 and 44 that run along the bank of cylinders 34. Passages 42 and 44 serve as an exhaust manifold for coolant used to cool the various cylinder side walls. In the illustrated system holes (ports) 46 extend between passages 42 and 12; similar ports extend between passages 44 and 10. Therefore, the air that cools the cylinder side wall also cools the cylinder end wall and associated valves.

Curved fin sections 25 transition smoothly from axial directions (where they connect with axially extending fins 36) to circumferential directions (where they join circumferential passage 40). Curved fin sections 25 cause each air slice (between fins) to have a longer residence time in contact with the fins (i.e., longer than it would if the fins extended vertically). The longer residence and higher velocity is helpful in handling the higher heat flux near the upper end of the combustion chamber.

In general, the heat transfer requirement is less at the lower end of the combustion chamber, and greater at the upper end of the combustion chamber (near surface 53). In accordance with this circumstance, the plenum area 38 around the lower end of cylinder wall 34 is left unfinned, the intermediate area of cylinder wall 34 has straight (axial) fins 36 thereon, and the upper area of cylinder wall 34 has curved fin sections 25 thereon.

As noted above, the curved fin sections 25 increase the air residence time and thus increase the heat transfer action. Heat transfer action may also be increased by increasing the fin density, i.e., by increasing the number of fins per inch of passage cross section. As shown in FIG. 1, auxiliary curved fins 23 are interposed between fin sections 25. Each fin 23 has a lower edge 28; the upper edge 33 of each fin 23 is in the same general plane as edges 27 of fin sections 25. FIG. 5 illustrates the general fin orientation. It will be seen that the fin density is greater for the curved fin sections and less for the straight fin sections (36). Fin density is related to heat transfer requirement. As noted above, heat transfer requirements are greatest at/near the upper end of the combustion chamber. As shown in FIG. 1, the fin density for the curved fins (25 and 23) is twice the fin density for straight fins 36. For example, there could be ten fins per inch for straight fins 36 and twenty fins per inch for the curved fins.

The outer surface of cylinder side wall 34 that borders annular passage 40 is unfinned. However, the air velocity in passage 40 is relatively high. Therefore, it is believed that the upper end area of wall 34 should be adequately cooled in spite of the fact that it has no heat transfer fins thereon.

Passages 42 and 44 could connect to any convenient low pressure zone, e.g., a discharge passage for a turbine in an engine supercharger. As shown in the drawings, these passages connect with ducts 10 and 12 via ports 46.

HEAT TRANSFER ACTION

The principal theme of my invention is the close confinement of the air flow while it is in heat transfer engagement with the hot engine surfaces; heat transfer action is enhanced by the fact that the various fins (18, 36 and 23) completely span the height of each passage. The fins extend longitudinally along the length dimensions of the passages so that air is forced to flow through the fin spaces, rather than flowing around or away from the fin spaces.

It is believed that the fins may be closely spaced without introducing excessive pressure drops into the air passage systems. Hopefully the system will have a lower air flow requirement than conventional engine coolant systems. As shown in FIG. 1, the fin density may be varied along the length of the combustion chamber in accordance with cooling requirements (i.e., no fins at the bottom end of the combustion chamber, and maximum fin density at/near the upper end of the combustion chamber).

U.S. Pat. No. 1,035,391 to H. Simpson shows an engine cooling system having some general similarities to my presently proposed system. However, the fin system in the Simpson appears to be relatively coarse, i.e., a small fin density. Also, Simpson appears to contemplate a single helical fin around the combustion cylinder; a single air slice would undergo an extreme heating action during multiple traverses around the cylinder. The Simpson patent does not show mechanism for cooling the combustion chamber end wall or associated valves.

U.S. Pat. No. 719,326 to H. Gross shows a system quite similar to the Simpson system. However, Gross apparently does not use a pre-pressurized source of coolant air. Apparently a skirt 21 on the piston produces a back-and-forth motion of the air in the finned area; air is alternately fed into and out of the finned space through a port 24. It is not believed that the Gross system would have a very high heat transfer efficiency.

Another prior art patent of possible interest is U.S. Pat. No. 2,209,078 to J. Gettinger. The patent appears to be generally along the lines of the above-mentioned Simpson patent. My invention is believed to be an advance over the systems shown in the various noted patents.

I wish it to be understood that I do not desire to be limited to the exact details of construction shown and described for obvious modifications will occur to a person skilled in the art, without departing from the spirit and scope of the appended claims.

I claim:

1. In an engine wherein a combustion chamber is defined by an end wall (39), a cylindrical side wall (34), and a movable piston (41) movable back and forth within the cylindrical side wall: the improvement comprising means for air-cooling the cylindrical side wall; said cooling means comprising wall structure defining an annular chamber surrounding the side wall; a pressurized air entrance port means in a portion of the chamber remote from the aforementioned end wall; an air exit port means in a portion of the chamber adjacent to said end wall; and closely spaced heat transfer fins arranged in the annular chamber to intercept pressurized coolant air flowing from the entrance port means to the exit port means; said heat transfer fins occupying the entire circumferential extent of the chamber; said heat transfer fins extending outwardly from the cylindrical side wall; said fins having radial dimensions that are the same as the radial dimension of the annular chamber whereby the air is required to move between fins in order to travel from the entrance port means to the exit port means; the fin density being relatively great near the combustion chamber end wall and relatively less remote from the combustion chamber end wall.

2. The improvement of claim 1 wherein the fins are spaced axially from the air entrance port means so that a circumferential section of the air chamber in direct contiguous communication with the entrance port means serves as an unobstructed air plenum.

3. The improvement of claim 2 wherein the fins include upstream fin sections extending generally axially along the cylindrical side wall, and curved downstream fin sections that transition from axial directions to circumferential directions.

4. The improvement of claim 3 and further comprising auxiliary curved heat transfer fins interposed between adjacent ones of the aforementioned curved fin sections.

5. The improvement of claim 1 wherein the downstream ends of the heat transfer fins are spaced axially from the plane of the combustion chamber end wall, such that a circumferential air exit passage (40) is formed to direct spent air toward the aforementioned air exit port means.

6. The improvement of claim 1 wherein said annular chamber has an axial dimension approximately the same as the axial dimension of the combustion chamber when the piston is in its bottom dead center position.

7. The improvement of claim 1 and further comprising means for air-cooling the combustion chamber end wall; said second-mentioned cooling means comprising at least one additional passage (14, 15 or 16) for pressurized air extending along said end wall in general parallelism with the combustion chamber end surface; said last mentioned passage having a height dimension normal to the plane of the combustion chamber end surface and a width dimension parallel to the plane of the combustion chamber end surface; and additional closely spaced heat transfer fins extending parallel to one another along the longitudinal dimension of the last mentioned passage; said additional heat transfer fins being oriented in planes parallel to the height dimension of the passage; said additional heat transfer fins extending the full height of the associated passage whereby all of the air flowing through the additional passage moves between fins.

8. The improvement of claim 7 wherein the combustion chamber has an intake valve and exhaust valve disposed in the chamber end wall for opening-closing motions; said additional passage extending around a peripheral edge of the exhaust valve for cooling same.

9. In an engine wherein a combustion chamber is defined by an end wall (39), a cylindrical side wall (34) and movable piston (41) movable back and forth within the cylindrical side wall: the improvement comprising means for air-cooling the combustion chamber end wall; said cooling means comprising at least one passage (14, 15 or 16) for pressurized air extending within said end wall in general parallelism with the combustion chamber end surface; said passage having a height dimension normal to the plane of the combustion chamber end surface and a width dimension parallel to the combustion chamber end surface; and closely spaced heat transfer fins extending parallel to one another along the longitudinal dimension of the passage; said fins being oriented in planes parallel to the height dimension of the passage; said fins extending the full height of the passage whereby all of the air flowing through the passage moves between fins.

10. The improvement of claim 9 wherein the passage is of uniform cross section along its length.

* * * * *